US005978994A

United States Patent [19]

Anderson

[11] Patent Number: 5,978,994

[45] Date of Patent: Nov. 9, 1999

[54] DEVICE AND METHOD FOR USE IN CLEANING LAUNDRY

[75] Inventor: Michael R. Anderson, Boca Raton, Fla.

[73] Assignee: Vision International Production, Inc., Boca Raton, Fla.

[21] Appl. No.: 09/038,345

[22] Filed: Mar. 11, 1998

Related U.S. Application Data

[60] Provisional application No. 60/040,471, Mar. 12, 1997.

[51] Int. Cl.[6] ..... D06F 39/00

[52] U.S. Cl. ..... 8/158; 8/137; 8/159; 68/17 R; 68/235 R; 206/0.5; 510/276; 510/281; 510/295; 510/297; 510/439

[58] Field of Search ..... 8/137, 158, 159; 68/17 R, 235 R; 206/0.5; 510/276, 281, 295, 297, 439

[56] References Cited

U.S. PATENT DOCUMENTS

| | | | |
|---|---|---|---|
| 4,255,273 | 3/1981 | Sakkab | 510/281 X |
| 4,795,032 | 1/1989 | Kandathil | 206/0.5 X |
| 4,929,367 | 5/1990 | Thomas et al. | 510/297 X |
| 5,211,689 | 5/1993 | Kobayashi | 206/0.5 |
| 5,658,870 | 8/1997 | Leu | 510/276 |
| 5,682,774 | 11/1997 | Baumgartner | 68/235 R |
| 5,814,592 | 9/1998 | Kahn et al. | 510/376 X |

OTHER PUBLICATIONS

The Condensed Chemical Dcitionary, tenth edition, by Hawley, page 568, 1981.

*Primary Examiner*—Philip R. Coe

*Attorney, Agent, or Firm*—Malin, Haley, DiMaggio & Crosby, PA

[57] ABSTRACT

A device, for use in a washing machine filled with water for cleaning surfaces without the use of detergent, comprising a water permeable housing containing a plurality of cation exchange resin beads, a quantity of tourmaline, a quantity of metal alloy such as copper micro-fibre strands, and a quantity of ferromagnetic material. The materials contained within the housing are in fluid communication with the laundry water and function to clean laundry by substantially reducing the quantity of dissolved solids in the water, neutralizing bacteria, germs and algae, and attracting positively charged particles from soiled laundry articles.

6 Claims, 1 Drawing Sheet

DEVICE AND METHOD FOR USE IN CLEANING LAUNDRY

This application claims the benefit of Provisional Application Ser. No. 60/040,471, filed Mar. 12, 1997.

BACKGROUND OF THE INVENTION

1. Field of the Invention

The present invention relates to devices for cleaning laundry, and more particularly, to a device for use in water for cleaning laundry without the use of detergents.

2. Description of the Background Art

Laundering of clothes and other fabrics to remove soil and other common contaminants is well known in the art, and is a part of daily living in many parts of the world. Prior to the mid twentieth century home laundering was a laborious task, usually consuming an entire day of work. Since World War II, however, great strides have been made in the convenience of home washing. The automatic washer and dryer revolutionized the chore of home laundering. Consequently, heating water to fill the washer, using the washer and wringer, and hanging linen and clothing to dry have become obsolete with the home laundering equipment now available. By merely loading clothes in a washing machine and adding detergent, the modern home machine automatically puts the clothes through a suds cycle and one or two rinse cycles. Thus, a person is freed to do other things while the wash is being done, and, instead of hanging the clothes to dry, a person can now remove them from the washer and quickly dry them in a dryer.

In the middle ages, soap was made at home and used for cleaning laundry. Cake soap, however, was a luxury product that came into common use only in the 19th century. The synthetic relatives of soap, detergents were developed during World War II when the natural ingredients for soap became scarce. Unlike soap, detergents are synthetics and do not form easily biodegradable waste products.

By the 1950's detergents had become more popular than soap for general laundering and dish washing since soap, when used in hard water (i.e. water that contains a large amount of dissolved mineral salts), reacts, unlike detergents, with the dissolved salts to form a whitish gray precipitate responsible for the common bathtub ring.

Sodium sulfonates make up the most common group of detergents. Sodium alkylbenzene sulfonate, or sodium ABS, was one of the earliest detergents. Its molecules comprise a long chain of hydrocarbons formed by linked carbon atoms having two hydrogen atoms attached to each carbon atom. The chain is not straight: the carbon atoms branch off at one end. This is the hydrophobic part that attaches to soil. Attachment to the soil is facilitated by the ionic attraction between the positively charged soil particles and the negatively charged hydrophobic end of the molecule. At the other end, a sodium sulfonate molecule attaches to water.

The detergents used for washing clothing also typically include a number of additives—for example, bleaches, brighteners, and abrasives. Bleaches whiten fabrics by destroying dirt and colors. Brighteners are chemicals that convert normally invisible ultraviolet light into visible light, such that additional light reflects back from the fabric, making it seem more vivid, or "whiter." Abrasives are ground-up particles of sand or other rock minerals added to detergents to scour stains.

The basic cleaning agents in detergents are called surface-active agents, or surfactants. When added to liquid, they reduce the liquids surface tension (the affinity that the liquid's surface molecules have for each other), thereby increasing the liquid's spreading and wetting properties. Part of the surface-active molecule is hydrophilic, or "water loving," and another part is hydrophobic, or water-repellant.

The seemingly simple action of cleaning a soiled surface is actually a complex four-step process. First, the surface to be cleaned is made wet. Soaps and detergents help the water spread out and wet the surface by penetrating the fabric fibers. Second, the surface absorbs the soap or detergent. The hydrophilic part of the surface-active molecule attaches itself to the water, and the hydrophobic part attaches itself to the solid or fiber, and most important, to the soil. In the third step, the soil is broken up into small beads that can be washed away. Mechanical agitation helps the surface-active molecules pull the dirt away from the material and into the water. Finally, the dirt is rinsed away in the water.

There are, however, a number of disadvantages with prior art laundering methods which rely on detergents. Namely, detergents used for washing clothing typically include a number of chemicals and additives such as bleaches, brighteners, and abrasives, which, when drained into sanitary sewer systems, comprise pollutants. Accordingly, there exists a need for a substitute for detergents and the like which facilitates the cleaning of surfaces without introducing undesirable chemicals directly into the environment.

SUMMARY OF THE INVENTION

A device for use in a washing machine filled with water, for cleaning laundry articles without the use of detergent. The device comprises a water permeable housing containing a plurality of cation exchange resin beads, a quantity of tourmaline, a quantity of metal, such as copper or other suitable metal alloy, and a quantity of ferromagnetic material. In the preferred embodiment, the water permeable housing includes the following quantities: 85 grams of cation exchange resin beads; 28 grams of tourmaline; 1 gram of copper micro-fibre strands; and, 3 grams of ferromagnetic material.

The device functions while submerged in water in a washing machine whereby the contents of the device are placed in fluid communication with the laundry water such that the contents react with the water and function to either treat the laundry water or to facilitate cleaning of the laundry. Specifically, the cation exchange resin beads function by creating an electrical charge which attracts oppositely charged particles, such as dissolved solids in the water, as well as soil and the like found on the material to be cleaned. The beads react with dissolved solids to cause the solids to adhere directly to the surface area of the beads thereby softening the water and reducing surface tension thus resulting in improved cleaning capability. The tourmaline material has piezoelectric properties which function to soften the water by causing dissolved solids to accumulate thereby further reducing the surface tension of the water for allowing the water to more easily pass between the fibers of the material to be cleaned. The metal alloy functions to purify the water by neutralizing bacteria, germs, algae, and the like, and removing dissolved metals, calcium carbonate, and iron.

In an alternate embodiment the water permeable housing is fabricated from a foam material impregnated by microencapsulated enzymes. As in the preferred embodiment, the foam material functions to house the materials, specifically, a plurality of cation exchange resin beads, a quantity of tourmaline, a quantity of copper micro-fibre strands, and a quantity of ferromagnetic material, as disclosed in the preferred embodiment while allowing water to pass therethrough. The microencapsulated enzymes are dispensed during the washing cycle by rupturing of the capsule walls, and function to enhance cleaning effectiveness by the release of cleaning enhancing enzymes during the laundering process. The released enzymes enhance cleaning effectiveness facilitating the removal of organic stains and eliminating odors.

Accordingly, it is an object of the present invention to provide a device for use with a washing machine for cleaning laundry articles without detergent.

Yet another object of the present invention is to provide a water permeable device containing a plurality of water purifying agents in a compact housing for cleaning laundry articles without detergent.

In accordance with these and other objects which will become apparent hereinafter, the instant invention will now be described with particular reference to the accompanying drawings.

DESCRIPTION OF THE PREFERRED EMBODIMENTS

Figure 1:
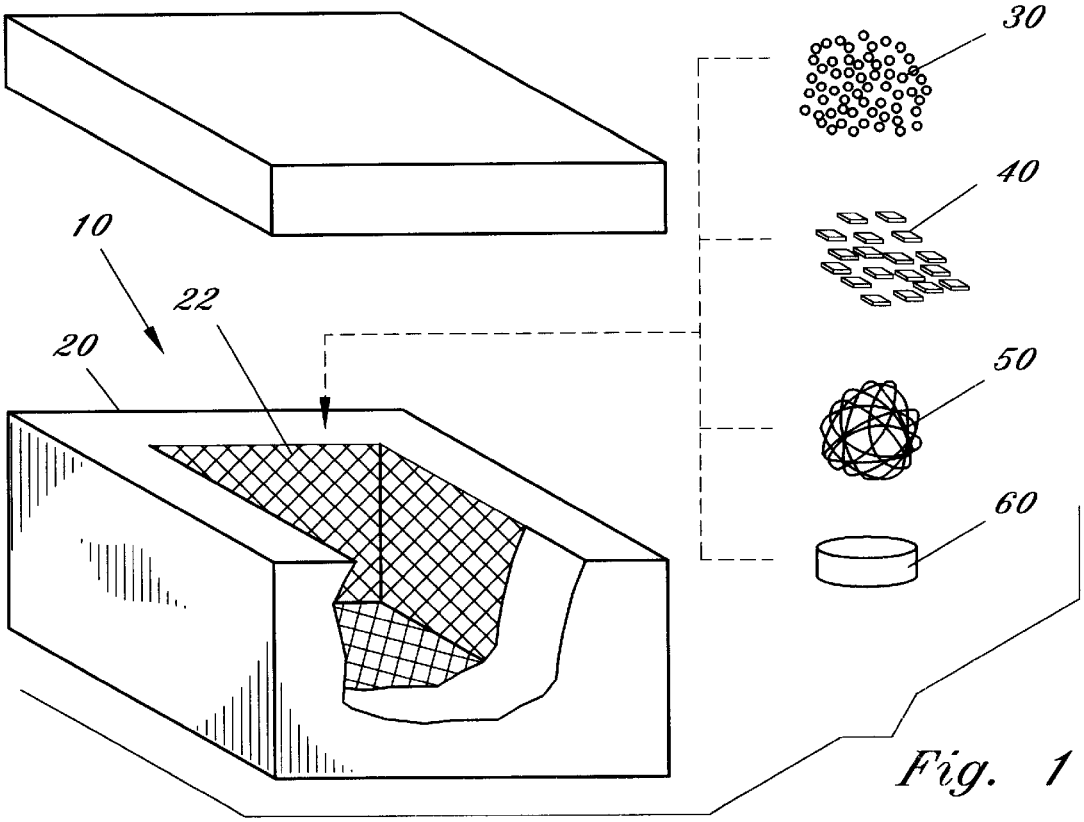
FIG. 1 is an exploded front perspective view of the preferred embodiment of the present invention partially cut-away.
Figure 2:
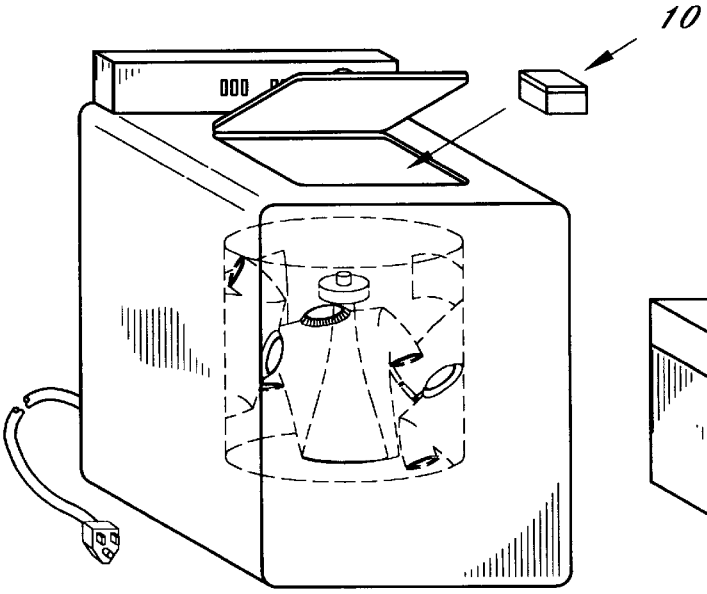
FIG. 2 is an exploded front perspective view of the preferred embodiment of the present invention and a washing machine.
Figure 1A:
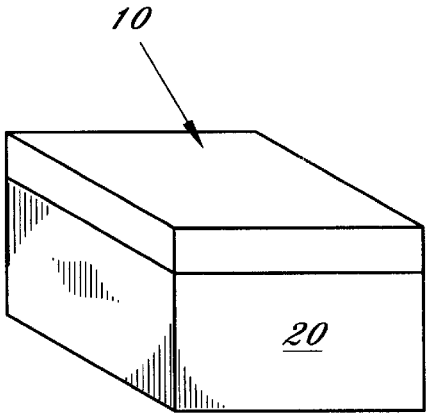
FIG. 1A is a front perspective view of the present invention.

FIGS. 1 and 1A depict a device for use in water, preferably with a washing machine, for cleaning material surfaces without the use of detergent. The device, generally referenced as 10, includes a water permeable housing 20 containing a plurality of cation exchange resin beads 30, a quantity of tourmaline 40, a quantity of metallic material 50, and a quantity of ferromagnetic material 60. In the preferred embodiment, the water permeable housing includes the above-referenced contents in the following quantities: 85 grams of cation exchange resin beads; 28 grams of tourmaline; 1 gram of copper micro-fibre strands; and, 3 grams of ferromagnetic material.

Housing 20 is fabricated from a foam material having sponge-like qualities; however, it is contemplated that any suitable water-permeable material, is within the scope of the invention. Furthermore, housing 20 may be fabricated from material which is not water-permeable provided apertures or the like are provided in the housing wall to allow water to easily flow through therethrough thereby placing the housing contents in fluid communication with water. In the preferred embodiment housing 20 is generally cube shaped, and defines an internal chamber for containing beads 30, tourmaline 40, metallic material 50, and ferromagnetic material 60 (hereinafter collectively "contents"). The contents of housing 20 may be further retained within the housing by a mesh net 22, as seen in FIG. 1. Net 22 may be fabricated from nylon or any other suitable material and functions to retain the contents within housing 20 while allowing water the flow freely therethrough. As is apparent, housing 20 need not be cube shaped, but may be of any suitable shape such as spherical provided the housing functions to retain the contents therein while maintaining the contents in fluid communication with the water within the washing machine.

Resin beads 30 are cation exchange resin beads comprising spherical particles formed substantially from Sulfonated divinylbenzene/styrene copolymer and water. Such cation exchange resin beads are known in the water treatment and purification arts for industrial water softening, dealkalinization, deionization or for chemical processing. An example of cation exchange resin material is a product sold by Rohm and Haas Company of Philadelphia, Pa., under its trademark AMBERLITE® IR120 NA. Beads 30 function to soften the water by removing grains of hardness (calculated as calcium carbonate), which grains tend to adhere to the surface area of the beads. As calcium carbonate, minerals, and other dissolved solids accumulate on beads, softening efficiency decreases; however, the beads may be regenerated by exposure to Sodium Chloride (NaCl), or salt water. Accordingly, it is desirable to periodically regenerate beads 30 by submerging the device 10 in salt water, thereby restoring maximum water softening capability and purging the device of any insoluble material which may have collected on the beads or within the housing.

Tourmaline 40 preferably comprises a quantity of crushed tourmaline mineral. A mineral is a naturally occurring homogenous solid which is inorganically formed and has a definite chemical composition and ordered atomic arrangement. Tourmaline generally consists of a complex Sodium Aluminum Silicate grouped in the class of silicates, subclass—tectosilicates, and group—feldspars. There are three main types of tourmaline which are distinguished by color and transparency. Elbaite is the gemstone tourmaline and is highly prized as a mineral specimen and gemstone. Schorl is an abundant, iron rich, form of tourmaline and is characterized as being black and opaque. Dravite is the least common from of tourmaline and forms translucent brown crystals. In the preferred embodiment the gemstone Elbaite is used, however, any form of tourmaline may be used.

Tourmaline is included in the preferred embodiment because of its piezoelectric properties. Specifically, when tourmaline crystals are heated, compressed, or vibrated, a different electrical charge will form at opposite ends of the crystal thereby forming an electric potential. Conversely, if an electrical potential is applied to the crystal, it will vibrate. The tourmaline's piezoelectric properties function in a laundry washing machine to create an electric potential which further softens the laundry water by reducing the level of dissolved solids thereby enhancing the cleaning effectiveness of the water.

In the preferred embodiment metallic material 50 comprises copper micro-fiber strands which function to neutralize organic contaminants such as bacteria, germs, and algae and remove impurities from the laundry water. Metallic material 50 preferably comprises strands of copper or copper alloy, which, through electrochemical, redox and absorption actions reduce and remove many unwanted contaminants from the laundry water. In an alternate embodiment the metallic material 50 may also include zinc and/or silver. The use of copper, zinc, and silver, in water purification is recognized, and any combination of those or other effective alloys is within the scope of the invention. Furthermore, any combination of high purity alloy structure, whether microfibre strands or non-strand particles or the like are considered within the scope of the invention.

A further example of a suitable material is a product sold by KDF Fluid Treatment, Inc. under its trademark KDF® 55. High purity alloys such as KDF® 55 medium comprising atomized high purity copper/zinc alloy, are effective in removing chlorine, heavy metals, iron, hydrogen sulfide, and for controlling bacteria, fungus, algae, and mold. These alloy materials further function as catalysts for oxidation reduction reactions and have been referred to generally as "redox media." Redox media is characterized as having an inherent electrochemical and catalytic potential. The electrochemical properties of redox media are explored in an article by Thomas M. Lotts, entitled "Where Oxidation Reduction Media Work—Here are five ways to use them", printed in WATER TECHNOLOGY (February 1994). Accordingly, the use of any suitable metal alloy in addition to, or in lieu of copper micro-fiber strands is considered within the scope of the invention.

In the preferred embodiment, ferromagnetic material 60 comprises a permanent magnet and may be disk shaped. Ferromagnetic material 60 functions to attract minerals, such as iron, existing in the laundry water thereby further softening the water by reducing the level of dissolved solids such that the water's surface tension is reduced for improved cleaning efficiency.

The present invention is used with a conventional washing machine to clean laundry and the like by inserting the device 10 into the machine, in lieu of other cleaning agents such as detergents or soaps, along with the clothing to be cleaned. It is important to note that the present invention neither contemplates, nor requires any modification to the washing machine's normal wash cycles. When the device is inserted and the laundry machine is turned on, the machine agitates the device and causes laundry water to flow through water permeable housing 20 and over cation exchange resin beads 30, tourmaline 40, alloy 50 (copper micro-fibre strands), and a ferromagnetic material 60. As discussed herein above, each of the housing contents functions to clean laundry by substantially reducing the quantity of contaminants and dissolved solids in the water and by attracting positively charged particles from soiled laundry articles. The present invention is also suitable for use with conventional laundry detergent, and facilitates the use of a lesser amount of detergent than would be required for a given level of cleaning effectiveness than the amount required without use of the device.

In the alternate embodiment, wherein housing 20 is fabricated from a foam material having microencapsulated enzymes incorporated therein, cleaning effectiveness is further enhanced. In this embodiment, the microencapsulated enzymes function to enhance cleaning effectiveness by being released during the laundering process. The benefits of using enzymes in the laundry cleaning process are well known, however, the use of microencapsulated enzymes in the laundry cleaning process provides significant advantages in that the device is capable of releasing the enzymes during multiple wash cycles. The released enzymes enhance cleaning effectiveness facilitating the removal of organic stains and eliminating odors. Specifically, with each wash cycle, agitation of housing 20 causes rupturing of some of the microcapsules thereby releasing enzymes directly into the laundry water wherein the enzymes react with the laundry to break down organic stains and eliminate odors.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A device for use in water in an automatic laundry washing machine for improving the laundry cleaning process, said device comprising:

a submersible body defining a chamber;

said chamber in fluid communication with the water in the washing machine when said body is submerged;

said chamber including a plurality of cation exchange resin beads, tourmaline, copper, and ferromagnetic material.

2. A device for use in water in an automatic laundry washing machine for improving the laundry cleaning process according to claim 1, wherein said submersible body is impregnated with microencapsulated enzymes.

3. A device for use in water in an automatic laundry washing machine for improving the laundry cleaning process, said device comprising:

a submersible body defining a chamber, said body formed of a foam material, said foam material impregnated with microcapsules containing enzymes, said microcapsules designed to release at least a portion of said enzymes during a wash cycle;

said chamber in fluid communication with the water in the washing machine when said body is submerged;

said chamber including a plurality of cation exchange resin beads for softening the water by removing calcium carbonate, the mineral tourmaline having piezoelectric properties for reducing the level of dissolved solids in the water, copper micro-fibre strands for neutralizing organic contaminants, and ferromagnetic material for attracting minerals, such as iron, thereby further softening the laundry water and reducing surface tension for enhancing the laundry cleaning process.

4. A device for use in water in an automatic laundry washing machine for improving the laundry cleaning process according to claim 3, wherein said chamber further includes redox media.

5. A method for cleaning laundry in a laundry cleaning machine having a water-filled, laundry receiving, agitating container, said method including the steps of:

(a) depositing a submersible body in the water-filled, laundry receiving, agitating container, said submersible body defining a chamber, said chamber in fluid communication with the water in the washing machine;

(b) exposing the water to water treatment agents, said water treatment agents including: a plurality of cation exchange resin beads for softening the water by removing calcium carbonate;

the mineral tourmaline having piezoelectric properties for reducing the level of dissolved solids in the water; copper micro-fibre strands for neutralizing organic contaminants; and ferromagnetic material for attracting minerals, such as iron, thereby further softening the laundry water and reducing surface tension for enhancing the laundry cleaning process.

6. A method for cleaning laundry in a laundry cleaning machine having a water-filled, laundry receiving, agitating container, according to claim 5, further including the steps of:

(a) exposing the water to microencapsulated enzymes, whereby agitation of the container causes the release of enzymes into the water, said enzymes resulting in enhanced cleaning effectiveness by facilitating the removal of organic stains from laundry.

* * * * *